US005762144A

United States Patent [19]

Lueddecke

[11] Patent Number: 5,762,144

[45] Date of Patent: Jun. 9, 1998

[54] SPRINKLER NOZZLE

[76] Inventor: Werner Lueddecke, Birkenweg 4, D-67259 Grossniedesheim, Germany

[21] Appl. No.: 732,441

[22] PCT Filed: May 17, 1995

[86] PCT No.: PCT/EP95/01880

§ 371 Date: Nov. 6, 1996

§ 102(e) Date: Nov. 6, 1996

[87] PCT Pub. No.: WO95/31253

PCT Pub. Date: Nov. 23, 1995

[30] Foreign Application Priority Data

May 18, 1994 [DE] Germany ..... 44 17 314.8

[51] Int. Cl.[6] ..... A62C 35/68

[52] U.S. Cl. ..... 169/37

[58] Field of Search ..... 169/37, 38

[56] References Cited

U.S. PATENT DOCUMENTS

| | | | |
|---|---|---|---|
| 2,085,987 | 7/1937 | Loepsinger . | |
| 2,528,063 | 10/1950 | Loepsinger | 169/38 |
| 2,768,696 | 10/1956 | Sherburne | 169/37 |
| 3,561,537 | 2/1971 | Dix et al. . | |
| 3,918,645 | 11/1975 | Mohler | 169/37 |

FOREIGN PATENT DOCUMENTS

| | | |
|---|---|---|
| 163012 | 9/1905 | Germany . |
| 2134461 | 7/1971 | Germany . |
| 3 225 798 | 1/1984 | Germany . |
| 9 215 957 U | 3/1993 | Germany . |
| 2213718 | 8/1989 | United Kingdom . |

*Primary Examiner*—Gary C. Hoge
*Attorney, Agent, or Firm*—Foley & Lardner

[57] ABSTRACT

The invention relates to a sprinkler nozzle for installation in commercial buildings to extinguish fires. The invention provides a cast one-piece design and dispersion of liquid over a larger area than prior art nozzles. In addition, the nozzle can be connected to multiple sources of liquid, such as water and foam, so that multiple agents can be mixed while the nozzle is operating.

11 Claims, 3 Drawing Sheets

SPRINKLER NOZZLE

BACKGROUND OF THE INVENTION

The present invention concerns a sprinkler such as is used for extinguishing fires in buildings, such as hotels or industrial plants.

Such sprinkler nozzles consist essentially of a liquid canal, e.g. with a pressurized water connection, a base cone with a determinate distance to the outlet of the canal and, arranged there-under, a distributor star with radial slits. The base cone and the head containing the canal are connected with one another via a bridge. The distributor star is a separate part and screwed to the base.

Such a sprinkler nozzle is known from German Utility Model G 92 15 957 in which the liquid canal tapers in the direction of flow and the generatrices of the canal converge in a support cone which carries the bent-formed distributor star on the base.

Furthermore, DE 3225 798 Al discloses a quenching sprinkler in which, after the ejection of a closure element in the form of a small glass drum, the quenching liquid is guided against a spray plate which is bent against the direction of flow and which carries a head receiver in the form of a bore in the middle of the plane of the indentations of the spray plate.

A disadvantage of the conventional sprinklers is that thee produce foam unsatisfactorily with only a small circle of sprinkling, for which reason special constructions are have been mostly used; that the radiating out from the distributor star takes place not radially but rather at a relatively great angle to the plane of the star; and that, in the case of liquids, relatively small projection distances are achieved. Furthermore, these nozzles are made up of several parts.

SUMMARY OF THE INVENTION

An abject of the present invention is to provide a sprinkler nozzle of the initially described kind which car be cast in one piece (brass) with the help of which foams can be produced with large coverages. It is another object of the invention to provide, considerably increased projection distances, can be achieved, the radiating, out of the foam produced or of the (quenching) liquids takes place essentially vertically to the middle axis of the nozzle.

The present invention comprises a sprinkler nozzle for the spraying of foam and/or water, especially for extinguishing purposes, which consists of a head part and a canal tapering in the direction of the supplied medium with Inlet and outlet, as well as bridge connected to this with supports spaced apart converging at the bottom between arranged a support cone which rests on a distributor star and whereby the distance between the outlet of the canal and the scattering pot is about the same as the distance between outlet and inlet of the head and whereby the generatrices of the conical tapering of the canal in the carrier cone converge. According to the invention, the support cone has a scattering pot which consists of a cylindrical bore and an inner cone as base, whereby the generatrices of the canal converge in the scattering pot and the surface of the distributor star encloses an angle $\alpha$ of 0° to 5°, preferably 3°, with the vertical plane to the middle axis of the nozzles.

With the nozzle according to the invention, it is possible to produce foam and water from such a nozzle so that, in the case of installation, the nozzle can be connected via two connections with two sources, whereby naturally, besides alternating supplying, it possible to mix foam-producing agents into the quenching waters.

Furthermore, with the present nozzle it is possible for the first time first to produce a quenching foam and, for example, after addition of the foam is complete the coverages of the foams produced do not differ fundamentally from those of the waters.

With a nozzle of the present invention, measured in a vertical distance from the lower edge of the distributor star of one meters, spray circles of up to 8.5 meters are achieved in comparison with conventional 5 to 6 meters. In each case, in the case of the measurement, a water pressure of 5 bar was applied to the nozzle and was produced via a 6 inch connection at 53 liters/minute.

In order to exclude undesired eddies and, for the avoidance of inhomogeneities produced by this, it is suggested to form the distributor star on the support cone. At the same time, this leads to a one-piece construction. Therefore, it is further suggested to produce the whole sprinkler in one piece as a cast part to reduce cost.

It has thereby been found that the distributor star must have a material thickness of about 5 mm which, surprisingly, also has a positive influence on the degree of action of the sprinklers.

An especially preferred geometry of the device consists of an outlet diameter of 6–8 mm, an inlet diameter of 13–17 mm, a length of the genetrix of the inner core of the head of about 40 mm—and an approximately just as large distance from the scattering pot—whereby the star possesses a diameter of about 30–40 mm (preferably of 35 mm), as well as 16 slits with a gap of, in each case, about 2.5 mm and a length of 6–8 mm.

Such a sprinkler nozzle is characterized by very great coverages and—as is desired in some cases of use—the inner portions the spray circle and less wet than the periphery. However, the present invention also permits a strong spraying also of the whole surface of the spray circle, by changing only the slit geometry. In the case of the above-mentioned distributor stars made for large coverages, the slit length amounts to about 6–8 mm, whereby the slits are all equally long. Surprisingly, a uniform impingement of the whole spray circle occurs when half of the slits are formed continuously up to the support cone, i.e. having a length of about 12–14 mm.

As conventional, the sprinkler nozzle is made from bronze. In particular, the canal is thereby also formed in the head with the casting so that a boring has to be subsequently introduced.

Furthermore, it is important to taper the supports at least in the region of the scattering pot to make them "streamline-shaped" with a somewhat elliptical cross-section.

Furthermore, it is suggested to provides shoulder on the support cone in the direction of the scattering pot which, together with the relatively sharp upper edge of the scattering pot, provides for a highly effective turbulence of the supplied medium before the impinging on the distributor star.

In addition, a an optimal geometry in which the radius of the star is about three times as great as the distance between the upper edge of the scattering pot and the star surface. A slight tilting of preferably maximum 3° of the star surface to the plane running vertically to the longitudinal axis, besides a radiating optimization, also simultaneously provides for ideal removal of the one-piece cast nozzle from the mold.

BRIEF DESCRIPTION OF THE DRAWING

The present invention is explained in more detail on the basis of the accompanying Figures.

DETAILED DESCRIPTION OF THE DRAWINGS

Figure 1:
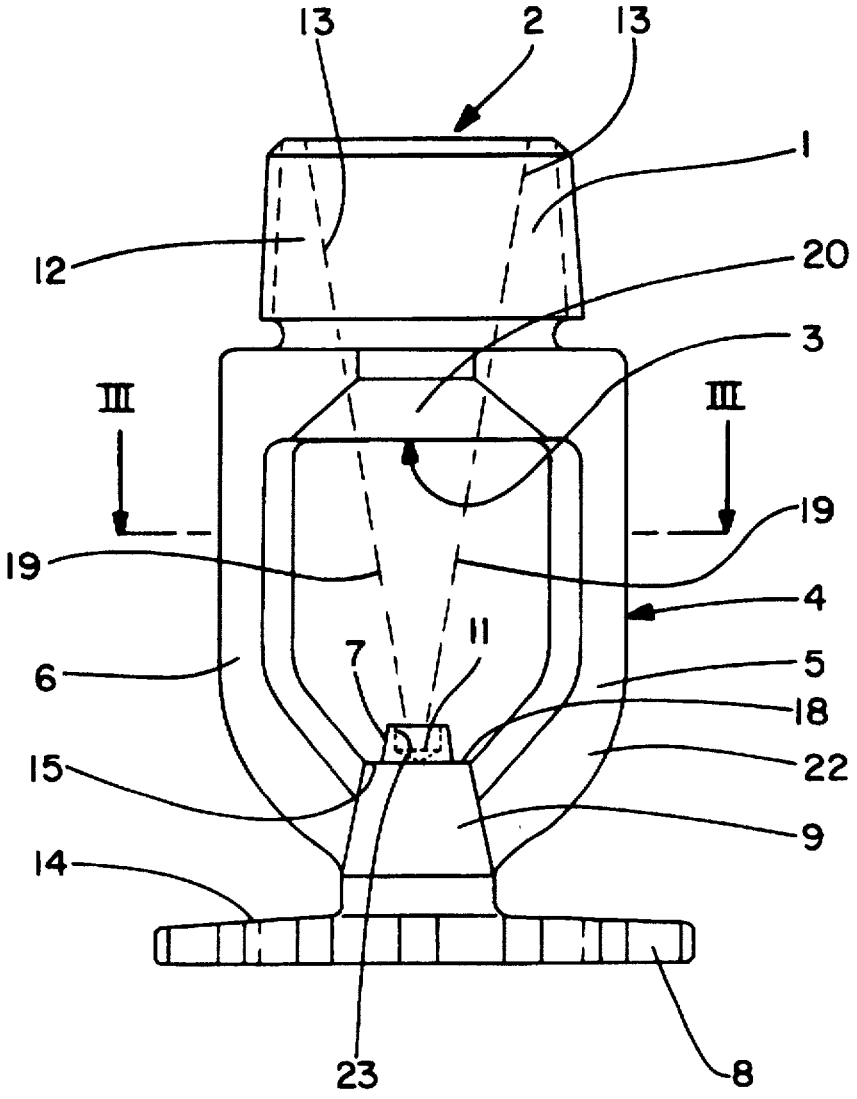
FIG. 1 shows the sprinkler in front view.

FIG. 1 shows the construction of the sprinkler nozzle according to the invention. It consists of the head 12 with an outer thread 16 so that the sprinkler may be screwed into a corresponding ceiling installation. The head 12 rests on a bridge 4 which comprises two lateral supports 5, 6 converging downwardly to a support cone 9. The supports 5, 6 taper downwardly and can rest on the support cone 9 or on the distributor star 8 on which they are then placed approximately vertically.

On the support cone 9 sits a relatively small scattering pot 7, whereby a shoulder 18 is formed on the support cone 9. Below the support cone 9, a distributor star 8 is formed in one piece with this.

In the head 12, between inlet 2 and outlet 3, is the present a conically converging canal 1, the generatrices 13 of which are so aligned or the cone of which is so dimensioned that its elongation (auxiliary line 19) converges in the scattering pot 7. In its base, the scattering pot 7 also has a smaller inner cone 11 which ends at the level of the shoulder 18. Above the inner cone 11 a cylindrical bore 25 is connected with this. The region below the head 12 has flattenings 20 directed obliquely inward between the supports 5, 6. At the height of the scattering pot 7, the supports 5, 6 are outwardly formed converging, i.e. they display corresponding taperings 22, in order thus to avoid a shading off of the flow by the supports 5, 6. The cross-section is preferably approximately elliptical.

The distance between the upper edge of inlet 2 and lower edge of outlet 3 is about the same size as the distance between lower edge of outlet 3 and the upper edge of the scattering pot 7. The following dimensions having proven to be especially useful: distance of scattering pot upper edge to lower edge out outlet 3 is 18 mm (diameter of outlet 6-8; diameter of inlet 2 is 11–14.7 mm) and distance of outlet-inlet edges is equal to 20 mm.

The scattering pot 7 has an upper opening with a diameter of about 4 mm and is about 2–5 mm deep (bore 23), whereby the support cone 9 possesses a height of about 10.5 mm and on the shoulder 18 a diameter of 7 and on the lower end on the distributor star 8 one of about 10 mm. The distributor star 8 is about 3 mm thick and has a diameter of about 36 mm, and is thus enlarged by about 20% in comparison with conventional devices.

Figure 2:
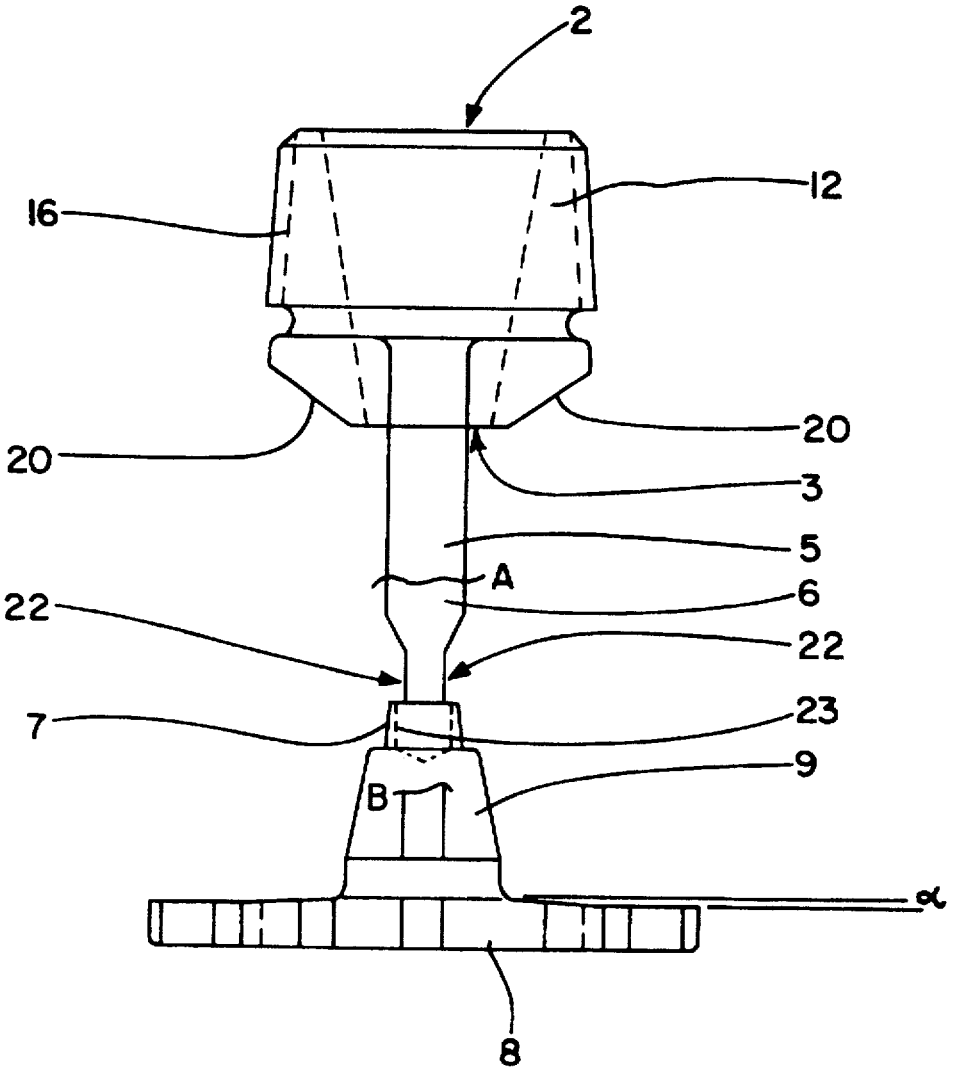
FIG. 2 is a side view of the sprinkler nozzle of the present invention.

FIG. 2 shows the same device in side view. FIG. 2 shows the head 12 with (conical) outer thread 16, the inlet 2 and the outlet 3, as well as the flattenings 20 on both sides. Between the flattenings 20 is present a support 5 which is formed on the support cone 9. The support core 9 carries the scattering pot 7 and rests on the distributor star 8. The supports 5, 6 can be formed running flatly but especially are rounded streamline-shape. The front support 5 is cut at A and B so that there is a clear view to She scattering pot 7. On the rear support 6 can be seen the tapering 22 on both sides which can readily be placed further up.

Figure 3:
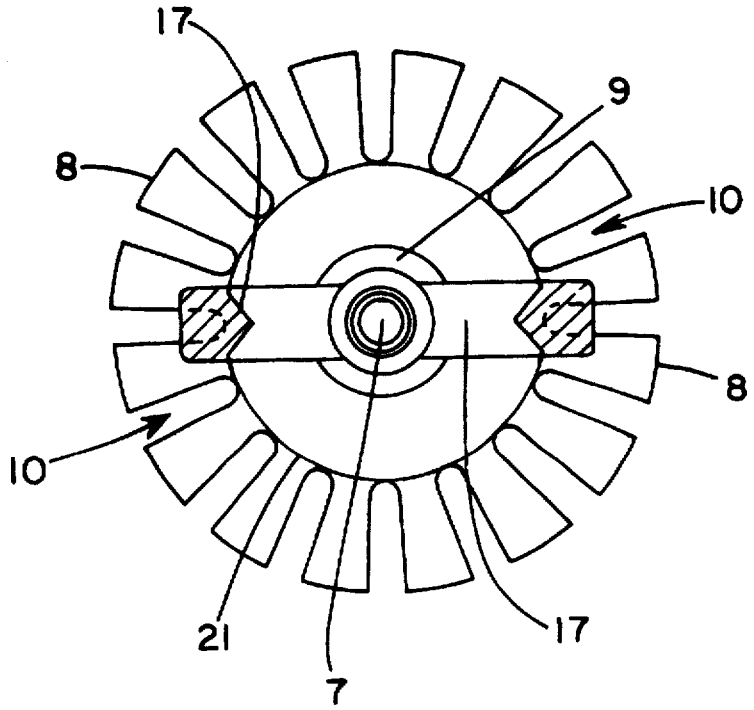
FIG. 3 is a sectional view taken along line A—A in FIG. 1.

FIG. 3 illustrates a Section A—A (of FIG. 1) and shows the view to the distributor star 8. The distributor star 8 is formed circularly and provided with sixteen slits 10 which end on an auxiliary circle 21. The slits are about 2.5 mm wide and are inwardly converging in order to be able to be taken from a mold. The auxiliary circle has a diameter of about 21 mm.

Centrally can be seen the support cone 9 which carries the scattering pot 7 on both sides of which lie the supports 5, 6 which are cut in the cross-hatched region and have the continuous bevellings 17.

In FIG. 3, all slits 10 are formed equally long, (about 7 mm in the case of a star diameter of about 17 mm). However, it is also possible to allow every second slit 10 to run through up to the support cone 9 in order to change the spray pattern, i.e. to impinge the edge less but the interior of the circle more strongly.

List of Reference

1 canal
2 inlet
3 outlet
4 bridge
5,6 supports
7 scattering pot
8 distributor star
9 support cone
10 radial slits
11 inner cone
12 head
13 generatrix
14 surface of distributor star
15 upper edge of support cone
16 external thread
17 bevelling
18 shoulder
19 auxiliary line
20 flattenings
21 auxiliary circle
22 taperings
23 cylindrical bore.

I claim:

1. A sprinkler nozzle for spraying a liquid, the nozzle comprising:

a head;

a conically tapered canal extending through the head and having an inlet and an outlet for conveying the liquid therethrough;

a bridge extending below the head and having supports spaced from each other and converging at a base;

a support cone disposed between the supports of the bridge and resting on a distributor star; and a scattering pot disposed upon the support cone and having a cylindrical bore, wherein a distance between the outlet of the conically tapered canal and the scattering pot is substantially equal to a distance between the inlet and the outlet of the canal, and wherein a plurality of generatrices of the conical tapering of the canal converge in the scattering pot, and wherein a surface of the distributor star which faces the head forms an angle $\alpha$ of 0° to 5° with a vertical plane of a middle axis of the nozzle.

2. A sprinkler nozzle according to claim 1, wherein the surface of the distributor star which faces the head forms an angle $\alpha$ of 3° with the vertical plane of the middle axis of the nozzle.

3. A sprinkler nozzle according to claim 1, wherein the distributor star is integrally formed with the support cone.

4. A sprinkler nozzle according to claim 1, wherein the distributor star has a thickness of about 3 mm.

5. A sprinkler nozzle according to claim 1, wherein a diameter of the outlet of the canal is between 6 mm and 8 mm, and a diameter of the inlet of the canal is between 13 mm and 17 mm, and wherein the distributor star has a diameter of approximately between 30 mm and 40 mm, and includes sixteen radial slits, each radial slit having a length of about 7 mm.

6. A sprinkler nozzle according to claim 1, wherein the distributor star has a diameter of approximately 35 mm.

7. A sprinkler nozzle according to claim 1, wherein each of said supports has a plurality of taperings disposed near the scattering pot.

8. A sprinkler nozzle according to claim 1, wherein the sprinkler nozzle is cast in a single piece and comprises bronze.

9. A sprinkler nozzle nozzle according to claim 1, wherein the scattering pot is formed in a conical shape, and wherein the support cone has a shoulder which is wider than the scattering pot and which supports the scatting pot.

10. A sprinkler nozzle according claim 1, wherein a radius of the distributor star is about three times greater than a distance from an upper edge of the scattering pot to the surface of the distributor star.

11. A sprinkler nozzle according to claim 5, wherein alternate ones of the radial slits extend to the support cone.

* * * * *

UNITED STATES PATENT AND TRADEMARK OFFICE

CERTIFICATE OF CORRECTION

PATENT NO. : 5,762,144

DATED : June 9, 1998

INVENTOR(S) : Werner Lueddecke

It is certified that error appears in the above-identified patent and that said Letters Patent is hereby corrected as shown below:

Column 3, line 4, delete "A-A" and insert --III-III--;

Column 3, line 57, delete "cut at" and insert --shown cut along lines--;

Column 3, line 61, delete "A-A" and insert --III-III--.

Signed and Sealed this

Ninth Day of February, 1999

*Attest:*

*Attesting Officer*

*Acting Commissioner of Patents and Trademarks*